US006863114B2

(12) United States Patent
Sillén

(10) Patent No.: US 6,863,114 B2
(45) Date of Patent: Mar. 8, 2005

(54) GATING SYSTEM

(75) Inventor: Rudolf Sillén, Ronneby (SE)

(73) Assignee: Novacast AB, Ronneby (SE)

( * ) Notice: Subject to any disclaimer, the term of this patent is extended or adjusted under 35 U.S.C. 154(b) by 179 days.

(21) Appl. No.: 10/169,559

(22) PCT Filed: Jan. 26, 2001

(86) PCT No.: PCT/SE01/00149

§ 371 (c)(1),
(2), (4) Date: Jul. 24, 2002

(87) PCT Pub. No.: WO01/54844

PCT Pub. Date: Aug. 2, 2001

(65) Prior Publication Data

US 2003/0029595 A1 Feb. 13, 2003

(30) Foreign Application Priority Data

Jan. 26, 2000 (SE) ..... 0000222

(51) Int. Cl.[7] ..... B22D 27/20
(52) U.S. Cl. ..... 164/349; 164/58.1; 164/244
(58) Field of Search ..... 164/244

(56) References Cited

U.S. PATENT DOCUMENTS

| | | | | |
|---|---|---|---|---|
| 3,746,078 A | | 7/1973 | Moore et al. | |
| 3,971,433 A | | 7/1976 | Duchenne | |
| 4,037,643 A | | 7/1977 | Mohla et al. | |
| 4,412,578 A | * | 11/1983 | Doliwa et al. | 164/349 |

FOREIGN PATENT DOCUMENTS

| | | |
|---|---|---|
| EP | 0 032 282 | 7/1981 |
| EP | 0 067 500 | 12/1982 |
| EP | 0 347 052 | 12/1989 |

* cited by examiner

*Primary Examiner*—Kuang Y. Lin
(74) *Attorney, Agent, or Firm*—Burns, Doane, Swecker & Mathis, L.L.P.

(57) ABSTRACT

A gating system for adding an alloying material to a molten base metal in immediate connection with a casting process. The gating system has a runner having an inlet whose cross-sectional area is throttled, a reaction chamber whose sectional area varies along the height of the reaction chamber as a function of the teeming rate, and a pressure and mixing chamber which is connected after the reaction chamber and provided with a partition. This results in a constant alloying material content of the metal being obtained at a varying teeming rate during the casting process.

20 Claims, 1 Drawing Sheet

GATING SYSTEM

FIELD OF THE INVENTION

The present invention relates to a gating system for adding an alloying material to a molten base metal in immediate connection with a casting process.

BACKGROUND ART

When casting iron alloys, a modification of the iron can take place prior to casting by adding different alloying materials to the pouring ladle or to a special treatment ladle. A different manner is to supply alloying materials successively during the actual casting process. One example is the Inmold process. In the Inmold process which is used for manufacturing nodular iron alloys a reaction chamber is formed in the mould drag. At one edge the reaction chamber is connected to the sprue of the gating system via a short duct and at the other edge to a duct leading to the inlets to the casting. A certain amount of crushed FeSiMg alloy containing about 5% magnesium is placed in the reaction chamber. When casting, the iron flows into the chamber, the FeSiMg alloy melting on the surface and being gradually dissolved in the iron flowing through the reaction chamber. About 0.35% magnesium is dissolved in the iron which gradually fills the casting cavity. In the solidification, carbon is separated in the form of graphite as nodules, which characterises nodular iron. If the amount of magnesium is too low, the iron can wholly or partly solidify as grey cast iron, which has significantly lower strength. To prevent this, the reaction chamber is somewhat oversized. What is essential in the manufacture of nodular iron is that the amount of magnesium is not allowed to be lower than a certain minimum level. Higher contents than the standard value-do not produce any considerable detrimental effects.

The sectional area of the reaction chamber is decisive of the amount of magnesium that is dissolved in the iron at a given teeming rate (kg/s). The sectional area is dimensioned to an average teeming rate and is constant along the height of the reaction chamber. If the teeming rate is not constant during the casting process but decreases, this results in the magnesium content of the iron gradually increasing in inverse proportion to the teeming rate. This takes place, for instance, if the delivery head in casting decreases by part of the casting cavity being positioned above the parting line of the mould. When manufacturing nodular iron this does not cause any major problems as mentioned above, since it is possible to operate with safety margins for the addition of magnesium.

However, problems arise if compacted graphite iron is to be manufactured by the Inmold process. Compacted graphite iron is characterised in that the carbon dissolved in the iron is separated as vermiform graphite particles, not as spheres as in nodular iron, or as thin flaky structures as in grey cast iron. The compact graphite form is an intermediate form which only arises within a very narrow magnesium range which is dependent on, inter alia, the material thickness. A typical range is 0.01 to 0.013%. Using the conventional Inmold process where the sectional area of the reaction chamber is constant, the magnesium content can increase from 0.01 up to 0.02% if the teeming rate during the later part of the casting is reduced to half the initial rate. As a result, the iron having the higher magnesium content will contain a small amount of compacted graphite and a large amount of nodular graphite, i.e. a mixture of compacted graphite iron and nodular iron.

Another problem in the manufacturing of compacted graphite iron is that the lower limit of magnesium is dependent on the nucleation state of the base iron. The nucleation state can be measured indirectly using different methods, for instance thermal analysis, and for optimal conditions, it would be necessary to vary the percentage of magnesium in the iron in relation to the nucleation state. This is not possible with the traditional Inmold process.

One more problem of the traditional Inmold process is that part of the first iron that reaches the reaction chamber owing to the kinetic energy passes into the duct from the reaction chamber without having been in immediate contact with the alloying material. The reaction chamber is not completely filled with metal until after a few seconds. This means that the first iron which flows into the casting cavity may in some cases have too low an alloying material content.

SUMMARY OF THE INVENTION

The object of the present invention is to provide a gating system for obtaining a constant alloying material content in the metal at a varying teeming rate during the casting process.

This object is achieved by a gating system of the type stated by way of introduction, which has the features defined in claim 1.

BRIEF DESCRIPTION OF THE DRAWING

The invention will now be described in more detail by way of example and with reference to the accompanying drawing, in which.

DESCRIPTION OF A PREFERRED EMBODIMENT

Figure 1:
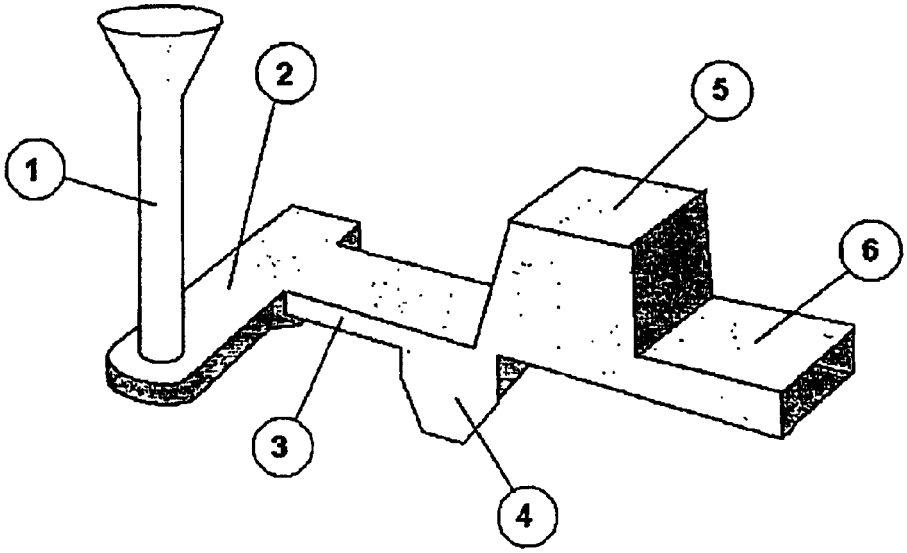
FIG. 1 is a perspective view and shows a preferred embodiment of the gating system of the invention.
Figure 2:
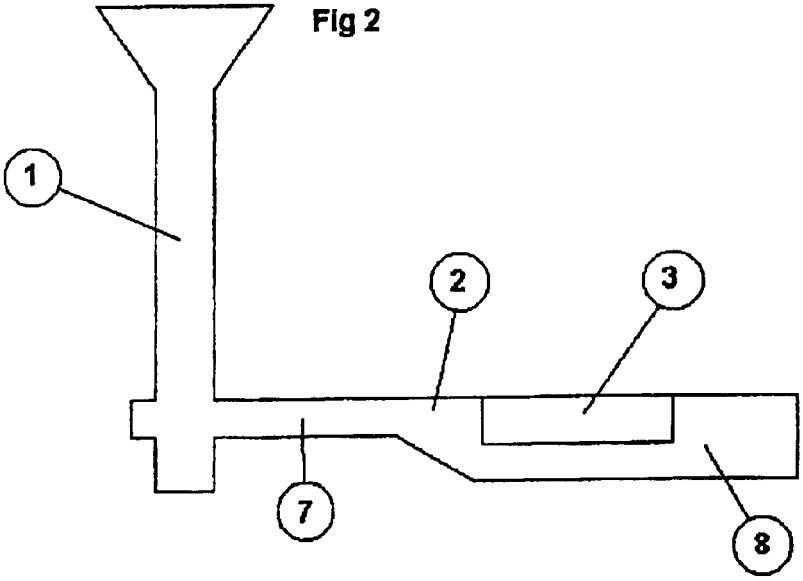
FIG. 2 is a sectional view and shows the first part of the gating system.

FIG. 1 shows an embodiment of a gating system for production of compacted graphite iron. The base iron is supplied to the system via a pouring ladle or founding furnace via a pouring cup and a sprue 1. A runner 2 is connected to the sprue 1. The first part 7 of the sprue (see FIG. 2) is of a cross-section which in prior-art manner has been dimensioned to obtain the desired flow and, thus, the desired duration of casting for the component which is to be cast. The second part of the runner 2 is formed with a cross-section which is three times that of the first part 7. In the second part of the runner 2 a connecting duct 3 is connected perpendicular to the reaction chamber 4. The runner 2 projects past the connecting point of the connecting duct 3. The extension 8 makes the flow stabilise in the sprue 1 before the base iron via the connecting duct reaches the reaction chamber 4. The cross-section of the connecting duct 3 is adjusted to the volume flow so that the rate to the reaction chamber 4 is less than 500 mm/s. The width of the connecting duct 3 is equal to the width of the reaction chamber 4.

The reaction chamber 4 is formed with a square cross-section and its sectional area on different levels is calculated according to the formula;

$$\text{Sectional area per level } (cm^2)=(Q\times DMg/100)/F$$

Q=Metal flow (g/s)

DMg=Desired magnesium content (%)

F=Factor for taking up magnesium from the reaction chamber ($g/cm^2/s$)

The alloying material, for instance FeSiMg having a particle size of 1–3 mm, is in known manner placed in the reaction chamber 4. During casting, metal flows through the upper part of the reaction chamber 4, and the alloying material melts gradually and is dissolved in the iron.

The flow of metal during the casting time is calculated in known manner with the aid of the current efficient pressure head at each point of time or by carrying out a computer-aided flow simulation. The height of the reaction chamber 4 is calculated in known manner in relation to the total amount of magnesium alloy and the density thereof as well as the sectional areas. The height of the upper part of the reaction chamber 4 is increased by at least the height of the connecting duct 3.

Figure 3:
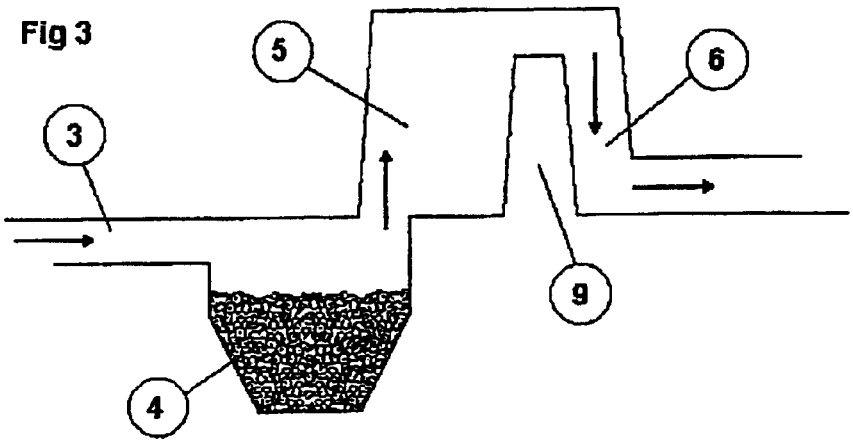
FIG. 3 is a sectional view and shows the second part of the gating system.

A pressure and mixing chamber 5 is arranged on the opposite side of the connecting duct 3 to the reaction chamber 4. The connection area to the reaction chamber 4 is equal to or greater than the area of the connecting duct 3. The pressure and mixing chamber 5 is divided by a partition 9 (see FIG. 3). The purpose of the partition 9 is to ensure that the reaction chamber 4 is completely filled with metal and is pressurised before metal is allowed to flow out in the outlet duct 6 leading to the casting cavity. The height of the partition is calculated according to the formula $$\text{Height of partition } (mm)=30+3\times\text{height of the inlet to the reaction chamber}$$

The height of the pressure and mixing chamber 5 is equal to the height of the partition 9 plus the height of the connecting duct 3 to the reaction chamber 4. The volume of the first part of the pressure and mixing chamber 5 is half the volume of the reaction chamber 4.

The outlet duct 6 from the pressure and mixing chamber 5 has a cross-sectional area which is equal to or greater than that of the connecting duct 3. The outlet duct 6 is connected either direct or via a ceramic metal filter to the casting cavity in known manner.

According to the invention, a desired variation of the magnesium content of the iron is obtained, to achieve an optimal level in relation to the metallurgical status of the base iron and the cooling rate of the casting component, in three ways.

First, the teeming rate, i.e. the flow through the reaction chamber 4, can be varied. Experiments have demonstrated that the take-up of magnesium from the alloying material in the reaction chamber 4 for a given alloying material is a function of exposed alloying material area and the time of contact with the liquid base iron. The take-up of magnesium as g $Mg/cm^2$ of reaction chamber area and second is established empirically by casting experiments. A normal value of commercial FeSiMg alloys containing about 4% Mg is 0.015 $g/cm^2$ of reaction chamber area and second. At a given sectional area, the take-up of magnesium can therefore be varied by varying the flow through the reaction chamber 4. In practice, this can easily be carried out by varying the casting time and, thus, the flow in kg/s by changing the throttle of the cross-sectional area at the beginning 7 of the runner. Most casting components withstand a variation of the casting time of +/−20% without any risk of casting defects. This makes it possible to vary the magnesium content within sufficiently wide limits in order to correct for variations in the base iron which affect the nucleation process of graphite.

Second, also an increase or decrease of the sectional area of the reaction chamber 4 at different levels allows a variation of the magnesium content. This can be carried out by using exchangeable patterns for the reaction chamber 4 or in some other manner varying the sectional area of the chamber. An increased area increases the take-up of magnesium and vice versa.

Third, the reaction chamber can be filled with a mixture of two different magnesium alloys with different dissolving capacity in order to vary the magnesium content of the iron. The dissolving capacity may be varied by varying the particle size of the magnesium alloy and/or by varying the magnesium content. The mixture is adjusted to the need for magnesium as a function of the properties of the base iron in the form of nucleation capacity, degree of oxidation and design and solidifying rate of the casting component.

What is claimed is:

1. A gating system for adding an alloying material to a molten base metal in immediate connection with a casting process for achieving a constant alloying material content of the metal at different teeming rates during the casting process, comprising a runner having an inlet, a reaction chamber, the inlet having a first cross-sectional area at a first part and a second cross-sectional area which size is different from that of the first cross-sectional area at a second part to define a throttle, the reaction chamber having a cross-sectional area of a size calculated as a function of a teeming rate anticipated through the reaction chamber, and a pressure and mixing chamber connected after the reaction chamber, the pressure and mixing chamber having a partition.

2. A gating system as claimed in claim 1 wherein the throttle is adapted to be varied.

3. A gating system as claimed in claim 1, wherein the size of the cross-sectional area of the reaction chamber varies proportionally to the teeming rate.

4. A gating system as claimed in claim 1, wherein the cross-sectional area of the reaction chamber is varied by using exchangeable patterns.

5. A gating system as claimed in claim 1, wherein a cross-sectional area of an outlet of the runner is at least 3 times the cross-sectional area of the inlet of the runner.

6. A gating system as claimed in claim 5, wherein the outlet of the runner is connected perpendicular to a connecting duct leading to the reaction chamber.

7. A grating system as claimed in claim 6, wherein the runner extends beyond a connecting point of the connecting duct to the reaction chamber.

8. A gating system as claimed in claim 6, wherein the cross-sectional area of the connecting duct permits an influx rate to the reaction chamber of < 500 mm/s.

9. A gating system as claimed in claim 6, wherein the connecting duct and the reaction chamber have a same width.

10. A gating system as claimed in claim 1, wherein the reaction chamber has a square sectional area.

11. A gating system as claimed in claim 1, wherein a cross-sectional area of a portion connecting the pressure and mixing chamber to the reaction chamber is ≧ cross-sectional area of a connecting duct connecting an outlet of the runner to the reaction chamber.

12. A gating system as claimed in claim 1, wherein a height of the partition of the pressure and mixing chamber is calculated according to the formula:

height (mm)=30+3×the height of a connecting duct connecting an outlet of the runner to the reaction chamber.

13. A gating system as claimed in claim 1, wherein a height of the pressure and mixing chamber is the height of the partition plus the height of the connecting duct connecting an outlet of the runner to the reaction chamber.

14. A gating system as claimed in claim 1, wherein a volume of a first part of the pressure and mixing chamber is half a volume of the reaction chamber.

15. A gating system as claimed in claim 1, wherein a cross-sectional area of the outlet duct of the pressure and mixing chamber is ≧ a cross-sectional area of the connecting duct.

16. A gating system as claimed in claim 2, wherein the size of the cross-sectional area of the reaction chamber varies proportionally to the teeming rate.

17. A gating system as claimed in claim 2, wherein the size of the cross-sectional area of the reaction chamber is variable by means of exchangeable patterns.

18. A gating system as claimed in claim 13, wherein the size of the cross-sectional area of the reaction chamber varies proportionally to the teeming rate.

19. A gating system as claimed in claim 16, wherein the cross-sectional area of the reaction chamber is varied by using exchangeable patterns.

20. A gating system as claimed in claim 2, wherein a cross-sectional area of an outlet of the runner is at least 3 times the cross-sectional area of the inlet of the runner.

* * * * *